United States Patent [19]

Gerzon

[11] 4,095,049

[45] June 13, 1978

[54] NON-ROTATIONALLY-SYMMETRIC SURROUND-SOUND ENCODING SYSTEM

[75] Inventor: Michael Anthony Gerzon, Oxford, England

[73] Assignee: National Research Development Corporation, London, England

[21] Appl. No.: 776,916

[22] Filed: Mar. 11, 1977

[30] Foreign Application Priority Data

Mar. 15, 1976 United Kingdom ..... 10191/76
Jan. 22, 1977 United Kingdom ..... 2686/77

[51] Int. Cl.[2] ..... H04R 5/00
[52] U.S. Cl. ..... 179/1 GQ; 179/100.1 TD
[58] Field of Search ..... 179/1 GQ, 15 BT, 100.1 TD, 179/100.4 ST, 1 G

[56] References Cited

U.S. PATENT DOCUMENTS

| | | | |
|---|---|---|---|
| 3,679,832 | 7/1972 | Halpern | 179/15 BT |
| 3,814,858 | 6/1974 | Parker | 179/15 BT |
| 3,824,342 | 7/1974 | Christensen et al. | 179/1 GQ |
| 3,906,156 | 9/1975 | Cooper | 179/1 GQ |
| 3,997,725 | 12/1976 | Gerzon | 179/1 GQ |

*Primary Examiner*—Douglas W. Olms
*Attorney, Agent, or Firm*—Cushman, Darby & Cushman

[57] ABSTRACT

In a surround-sound encoding system which does not have full circular or square symmetry, a third channel is added to a basic two channel system in such a way that the third channel may be reduced in amplitude or restricted in frequency without substantially affecting important localization criteria. The encoder includes a phase-amplitude matrix such that a decoder having a phase-amplitude matrix which is the inverse of the encoder phase-amplitude matrix is such that the absence of the third channel signals at the input thereof does not affect localization in at least three, preferably six, predetermined directions.

22 Claims, 2 Drawing Figures

Figure 1:
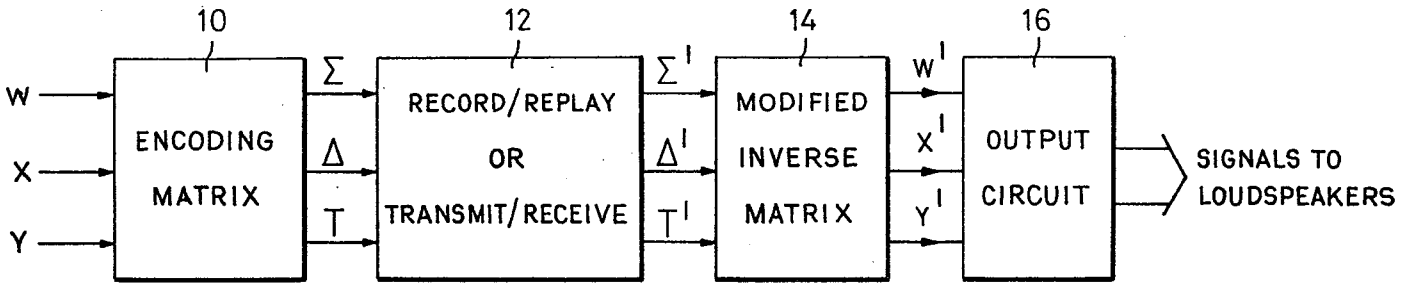

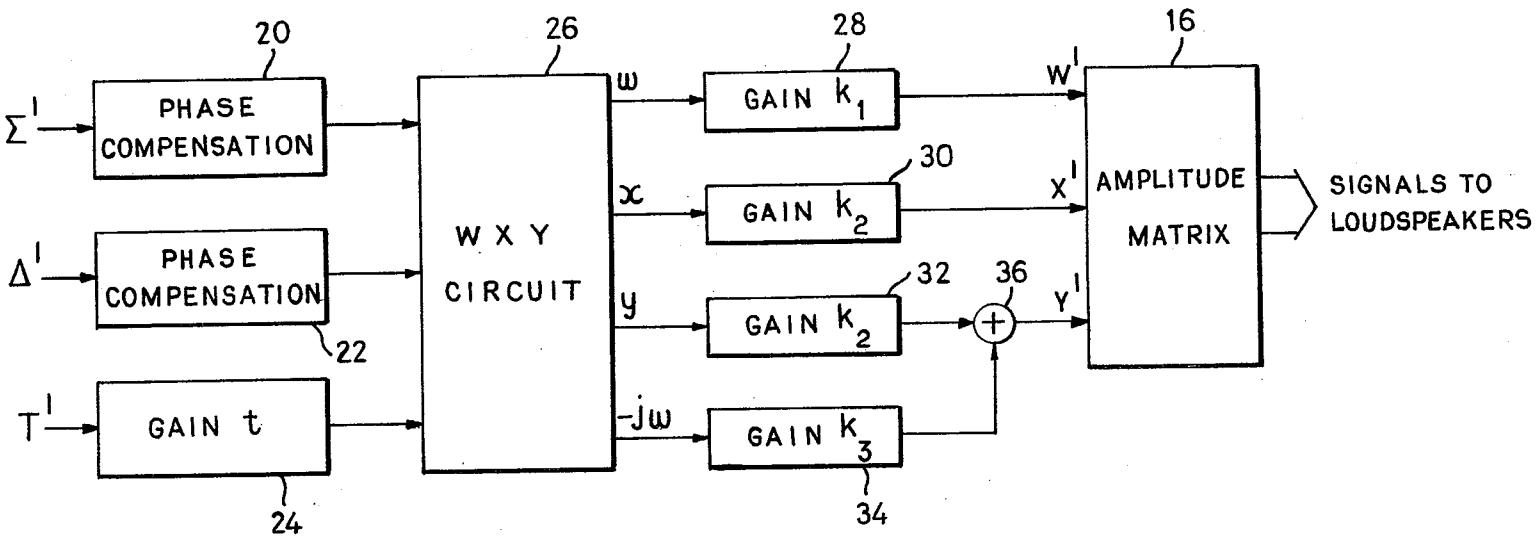
—FIG. 2—

NON-ROTATIONALLY-SYMMETRIC SURROUND-SOUND ENCODING SYSTEM

This invention relates to sound reproduction systems and more particularly to sound reproduction systems which enable a listener to distinguish sound from sources extending over 360° of aximuth. Such systems are hereinafter called surround sound systems. The invention is also applicable to sound reproduction systems of this type which in addition enable the listener to distinguish sound from sources at different heights.

U.S. Pat. No. 3,997,725 and copending application Ser. No. 430519 describe two-channel surround sound systems in which one channel carries a so-called omnidirectional signal and the other channel carries a so-called azimuth or phasor signal of the kind in which the relative phase of the phasor signal is equal to plus or minus the azimuth angle and the gain does not vary with direction. Alternatively, the two channels may carry signals which are linear combinations of the omnidirectional and phasor signals. Systems using this kind of encoding are said to be rotationally symmetric.

U.S. Pat. No. 3,856,992 discloses a system of the above type in which a third channel has been added to improve localisation. In the case of a gramophone disc recording, this channel is conveyed by a modulation of one or more ultrasonic sub-carriers, the first two channels being directly recorded on the two groove walls, and, in the case of FM radio, the third channel modulates a suppressed sub-carrier A.M. signal in quadrature with another such sub-carrier signal. Consequently such third channel may be of restricted frequency range and/or maximum amplitude level and may be more susceptible to noise and other interference than the other two channels. It is therefore desirable to so arrange the system that the relative gain of the third channel fed to the decoder may be reduced without serious deleterious effect on sound localisation.

In this specification, it is assumed that all azimuth angles are measured in the same sense, i.e. either all anticlockwise or all clockwise.

According to the invention in one aspect, there is provided a system for transmitting or recording an azimuthal directional sound comprising encoding means producing a plurality of transmission channel signals comprising complex linear combinations of omnidirectional signal components, signal components having gains equal to the cosine of the encoded sound azimuthal angle and signal components having gains equal to the sine of the encoded sound azimuthal angle, the encoding means comprising a phase-amplitude matrix arranged to produce first, second and third transmission channel signals, the first and second transmission channel signals together being non-rotationally-symmetric and the third transmission channel signal being arranged so that a second phase-amplitude matrix, being the inverse of said first phase-amplitude matrix, which would produce three recovered signals from said first, second and third transmission signals, the first of said recovered signals having an omnidirectional gain and the second and third of said recovered signals having respective gains equal to the cosine and sine of said encoded azimuthal angle, would also produce, in the absence of said third transmission signal from the input of said inverse matrix, three respective modified recovered signals such that the real part of the ratio of the complex gain of said second modified recovered signal to the complex gain of said first modified recovered signal and the real part of the ratio of the complex gain of said third modified recovered signal to the complex gain of said first modified recovered signal are the orthogonal components of a vector pointing in the direction of the encoded azimuth angle for at least three predetermined azimuthal angles subtending at least 180°.

According to the invention in another aspect, means for reproducing azimuthal directional sound transmitted or recorded by the above described system comprises means for producing feed signals from a plurality of transmission channel signals, the feed signals being arranged to produce at a predetermined listening position, via loudspeaker transducing means, acoustic pressure and an acoustic velocity vector such that, at each frequency of sound, the vector formed by the components of the complex acoustic velocity vector bearing a quadrature phase relationship to the components of the acoustic pressure points in a decoded azimuth angle direction is substantially equal to said encoded azimuth angle direction for all encoded azimuth angles.

It will be appreciated that the acoustic velocity of a distant sound is proportional to the differential with respect to time of the acoustic pressure of such sound, and that the effect of differentiation is to boost treble frequencies at a rate of 6dB/octave accompanied by a 90° phase shift. As a consequence, the quadrature phase relation mentioned above corresponds to an 0° or 180° phase relation for the electrical signals representative of acoustic pressure and velocity.

The decoder preferably includes a so-called "modified inverse matrix" comprising a phase-amplitude matrix which is the inverse of the phase-amplitude matrix of the encoder, modified by gain factors which may be frequency-dependent. However, such factors may be unity in which case the phase-amplitude matrix of the decoding means is the exact inverse of the phase-amplitude matrix of the encoding means.

The "modified inverse matrix" may also be arranged to provide further outputs such as a fourth output equal to the signal representative of acoustic pressure phase-shifted by 90°. The matrix may also be modified so that the outputs are real lienar combinations of the aforesaid matrix output signals.

Preferably the encoder is so arranged that the vector derived from the modified recovered signals points in the direction of the encoded azimuth angle for six predetermined angles which may be symmetrically disposed relative to a reference direction. According to a preferred feature of the invention, such six azimuth angles are symmetrical relative to two mutually orthogonal reference directions. The six angles may conveniently be 0°, 60°, 120°, 180°, −60° and −120°. According to a preferred form of the invention, where the encoding means is such that the first and second transmission channel signals represent sounds associated with an azimuth angle $\theta$ by having respective complex gains which are the same real or complex multiple of either $L_{gain}$ and $R_{gain}$ given by:

$$L_{gain} = \tfrac{1}{2}(a + jb) + \tfrac{1}{2}(c + jd)\cos\theta + \tfrac{1}{2}(ej + f)\sin\theta$$

$$R_{gain} = \tfrac{1}{2}(a - jb) + \tfrac{1}{2}(c - jd)\cos\theta + \tfrac{1}{2}(ej - f)\sin\theta$$

or $\Sigma_{gain}$ and $\Delta_{gain}$ given by:

$$\Sigma_{gain} = a + c\cos\theta + je\sin\theta$$

$$\Delta_{gain} = jb + jd\cos\theta + f\sin\theta$$

where $j(=\sqrt{-1})$ represents a 90° phase shift and where $a, b, c, d, e,$ and $f$ are real gains and the third transmission channel signal has a gain $T_{gain}$ given by:

$$T_{gain} = q\,(jg + jh\cos\theta - \sin\theta)$$

where $q$ is a non-zero complex gain and $g$ and $h$ are real gains. For the purposes of subsequent reference the quantities $u$ and $v$ are defined as follows:

$$u = \frac{cf + ed}{bc - ad} \qquad v = -\frac{be + af}{bc - ad}$$

In such encoding systems if $\theta$ is changed to $-\theta$, $j$ to $-j$ and $L_{gain}$ and $R_{gain}$ are interchanged, the resulting equations are unaltered apart from a possible change in the overall phase of T. Consequently, such systems are hereinafter referred to as "encoding systems having left/right symmetry".

In such an encoding system having left/right symmetry, it may be preferred that the six predetermined azimuthal angles are symmetrically disposed about two mutually orthogonal reference directions, taking the values $\theta = 0, \pm\theta', 180° \pm \theta'$ and 180°. In such a case the gains $g$ and $h$ are such that:

$$h = v^{-1}\left\{\frac{1 + u^2\sin^2\theta'}{1 - (u/v)^2\cos^2\theta'}\right\}^{\frac{1}{2}}$$

$$g = \frac{h^2}{1 + vh}\left\{\frac{u\,(\cos^2\theta' + v^2\sin^2\theta')}{1 + u^2\sin^2\theta'}\right\}$$

In the particular case when the six predetermined azimuthal angles are 0°, 60°, 120°, 180°, −60° and −120°, the gains $g$ and $h$ are found to be of the following form:

$$h = v^{-1}\left\{\frac{4 + 3u^2}{4 - (\frac{u}{v})^2}\right\}^{\frac{1}{2}}$$

$$g = \frac{h^2}{1 + vh}\left\{\frac{u\,(1 + 3v^2)}{4 + 3u^2}\right\}$$

In many practical systems, it is found that these values of $g$ and $h$ are well approximated by the formulae:

$$g = \frac{u}{\sqrt{1.65 + 2v + 0.35v + 0.65u^2}}$$

$$h = \frac{1}{v}\sqrt{1 + u^2\,(1.12 - 0.12(v^2 - u^2))}$$

Encoding systems are within the scope of the invention provided that the coefficient $g$ does not deviate from the above values by more than 50% and the coefficient $h$ does not deviate by more than 25%.

The input signals for the encoding means may be derived from a microphone assembly, which may include matrixing means, producing at least three intermediate signals, the first of which is an omnidirectional signal comprising the sum of all azimuthal sound sources with identical gains, the second of which is the sum of the signals of all azimuthal sound sources each having gain proportional to the cosine of its respective encoded azimuthal angle, and the third of said intermediate signals comprising the sum of the signals of all azimuthal sound sources each having gain proportional to the sine of its respective encoded azimuthal angle.

Alternatively the input signals for the encoding means may be produced by a plurality of independent monophonic signal sources and an amplitude matrix mixing means producing three or more intermediate signals, the first of such intermediate signals comprising the sum of all said monophonic signals with identical gains, the second of said intermediate signals comprising the sum of all said monophonic signals after each has been subject to a gain proportional to the cosine of its respective encoded azimuth angle and the third of such intermediate signals comprising the sum of all the monophonic signals after each has been subject to a gain proportional to the sine of its respective encoded azimuthal angle.

As a further alternative, the input signals may comprise four signals LB, LF, RF and RB representing sound at left back, left front, right front and right back respectively, and an amplitude matrix producing three intermediate signals W, X and Y given by:

$$W = m\,[k_F^{-1}(LF + RF) + 1k_B^{-1}(LB + RB)]$$

$$X = n\,[(LF + RF) - 1\,(LB + RB)]$$

$$Y = n\,[(LF - RF) + 1\,(LB - RB)]$$

where $m$ and $n$ are greater than zero and where $k_F$, $k_B$ and $l$ are positive gains such that $$2^{-\frac{1}{2}} \leqq k_F \leqq 1$$

$$2^{-\frac{1}{2}} \leqq k_B \leqq 1$$

$$2^{-\frac{1}{2}} \leqq 1 \leqq 2^{\frac{1}{2}}$$

It should be understood that, in the case when $u = 0$ and $v = \mp 1$, the system is rotationally symmetric and does not fall within the scope of the present invention.

Embodiments of the invention will now be described by way of example with reference to the accompanying drawings in which:

FIG. 1 is a block diagram of an encoding and decoding system in accordance with the invention, and FIG. 2 is a block diagram illustrating in more detail one form of the decoder of the system shown in FIG. 1.

In the following description, it is assumed that all azimuth angles are measured anticlockwise.

FIG. 1 shows schematically a sound reproduction system in which input signals W, X and Y are applied to an encoder 10 and the encoded signals therefrom Σ, Δ and T are transmitted via a system 12 to a decoder 14, including a "modified inverse matrix", which produces output signals W′, X′ and Y′, and output circuit 16 which produces output signals for feeding, via suitable amplification to loudspeakers. The system 12 may comprise a recorder and a replay unit or a transmitter and a receiver. It should be understood that the components of the system 12 may be separated geographically and/or in time and that signals passing therethrough may be subject to attenuation, band-limiting and/or other forms of modification and degradation so that the signals applied to the decoder are $\Sigma'$, $\Delta'$ and $T'$.

The input signal W is an omnidirectional signal while the signals X and Y have gains proportional to the cosine and to the sine respectively of the encoded sound azimuth angle $\theta$ which is measured from a first reference direction.

The encoder 10 is arranged to operate in accordance with the following encoding equations:

$$\begin{pmatrix} \Sigma \\ \Delta \\ T \end{pmatrix}_{gain} = \begin{pmatrix} a & c & ej \\ bj & dj & f \\ qgj & qhj & qi \end{pmatrix} \begin{pmatrix} 1 \\ \cos\theta \\ \sin\theta \end{pmatrix}$$

where $j\ (=\sqrt{-1})$ represents a 90° phase shift and $a$, $b$, $c$, $d$, $e$, $f$, $g$, $h$ and $i$ are real gains and $q$ is a nonzero complex gain.

The inverse matrix 14 performs the function of the following decoding equations:

$$\begin{pmatrix} W' \\ X' \\ Y' \end{pmatrix}_{gain} =$$

$$\begin{pmatrix} k_1a' & k_1c'j & k_1te'j \\ k_2b' & k_2d'j & k_2tf'j \\ k_2g'j - \frac{1}{2}k_3ja' & k_2h' + \frac{1}{2}k_3c' & k_2ti' + \frac{1}{2}k_3te' \end{pmatrix} \begin{pmatrix} \Sigma' \\ \Delta' \\ q^{-1}T' \end{pmatrix}$$

$$\begin{pmatrix} a' & c'j & e'j \\ b' & d'j & f'j \\ g'j & h' & i' \end{pmatrix} = \begin{pmatrix} a & c & ej \\ bj & dj & f \\ gj & hj & i \end{pmatrix}^{-1}$$

$k_1$ and $k_2$ are positive gains and $k_3$ and $t$ real gains, $t$ being the gain of the third channel. All these gains may be frequency-dependent and chosen to optimise the various aspects of subjective reproduction. The gain $k_3$ is a directional bias gain as described in copending application Ser. No. 738,591.

Where the output matrix 16 is required to provide signals for a regular polygonal loudspeaker layout, the outputs therefrom are such that a loudspeaker at azimuth $\phi$ measured from a second reference direction is fed with a signal $P_\phi$ given by:

$$P_\phi = W' + 2X' \cos\phi + 2Y' \sin\phi$$

It should be noted that, before the signals $P_{100}$ are derived, the signals X' and Y' may be subject to an RC high-pass filter to compensate for loudspeaker distance as described in U.S. Pat. No. 3,997,725.

For rectangular loudspeaker layouts with loudspeaker azimuths $\phi$, $180°-\phi$, $-180°+\phi$ and $-\phi$, the respective speaker feed signals may be $P_{90°-\phi}$, $P_{90°+\phi}$, $P_{-90°-\phi}$ and $P_{-90°+\phi}$, as described in U.S. Pat. No. 3,997,725.

Various encoder matrices, in which the six predetermined azimuth angles are 0°, ±60°, ±120° and 180°, will now be described by way of example. The first three of these are so-called JT systems in which:

$$u = -1/\sqrt{8} = -0.354$$

$$v = 3/\sqrt{8} = 1.061$$

An alternative to the JT systems described above is so-called system HT which is based on the BBC 2-channel "matrix H" encoding system and in which $$u = -0.170$$

$$v = +1.473$$

The values of the various coefficients $a$ to $i$ of the encode matrix and the corresponding coefficients $a'$ to $i'$ of the corresponding inverse matrix for systems 45JT, 55JT, 65JT and HT are shown in the following Table I.

Table I

| System | 45JT | 55JT | 65JT | HT |
|---|---|---|---|---|
| a | 0.9530 | 0.9694 | 0.9829 | 0.9915 |
| b | −0.3029 | −0.2457 | −0.1842 | −0.1305 |
| c | 0.2554 | 0.2191 | 0.1725 | 0.2030 |
| d | 0.8034 | 0.8643 | 0.9203 | 0.6580 |
| e | 0.0661 | 0.1104 | 0.1645 | −0.1305 |
| f | 0.9593 | 1.0036 | 1.0412 | 0.9915 |
| g | −0.1716 | −0.1716 | −0.1716 | −0.0733 |
| h | 1.0000 | 1.0000 | 1.0000 | 0.6873 |
| i | −1.0000 | −1.0000 | −1.0000 | −1.0000 |
| a' | 0.9857 | 0.9876 | 0.9876 | 0.9744 |
| 2b' | 0.5228 | 0.4418 | 0.3654 | 0.2956 |
| c' | 0.1058 | 0.0575 | 0.0040 | 0.2129 |
| 2d' | −1.0785 | −1.0450 | −1.0181 | −1.4286 |
| e' | 0.1667 | 0.1667 | 0.1667 | 0.0839 |
| 2f' | −1.0000 | −1.0000 | −1.0000 | −1.4549 |
| 2g' | 0.1846 | 0.1030 | 0.0265 | 0.0603 |
| 2h' | 1.1148 | 1.0647 | 1.0195 | 1.0131 |
| 2i' | −0.9428 | −0.9428 | −0.9428 | −0.9877 |

The factors 2 in Table I arises from the factors 2 in the above expression for $P_\phi$. The apparent sound azimuth produced by such decoders for any gain $t$ between 0 and 1 according to Makita's theory of localisation agrees with the encoded azimuth to within about 2°. For both $t = 0$ and $t = 1$, such decoders give apparent sound azimuths according to Makita's theory equal to the encoded azimuths for the six predetermined directions 0°, ±60°, ±120° and 180°.

The parameters $k_1$, $k_2$, $k_3$ and $t$ in the above decoding equations have preferred values depending on the number of channels available, the complexity of the decoder and whether account is taken of the frequency-dependence of sound localisation by the human ear. In the special case when all three channels are available for the full bandwidths, one may put $k_1 = k_2 = t = 1$ and $k_3 = 0$. Then W' has directional gain 1, X' has directional gain $\cos\theta$ and Y' has directional gain $\sin\theta$. In general, it is found that satisfactory decoded azimuthal results are obtained according to the localisation theory of Makita when:

$$Re\,(X'/W') : Re\,(Y'/W') \simeq \cos\theta : \sin\theta$$

where $Re$ means "the real part of". Thus, if the output matrix 16 (FIG. 1) is a suitably designed amplitude matrix, a substantially correct azimuth will be obtained whatever the values of $k_1$, $k_2$, $k_3$ and $t$, so long as $k_1>0$, $k_2>0$ and $-0.2<t<1.4$. For example, for a regular polygonal layout of at least four loudspeakers each at respective azimuth angle $\theta$, the feed signal for each loudspeaker is given by $$P_\phi = W' + 2X' \cos\phi + 2Y' \sin\phi$$

as stated above.

Thus, if the output matrix 16 is a suitably designed amplitude matrix, feeding an appropriate loudspeaker layout, substantially correct Makita azimuths are obtained whatever the values of $k_1$, $k_2$, $k_3$ and $t$, so long as $k_1$, $k_2>0$ and $-0.2<t-1.4$. Examples of appropriate values for these parameters for JT system decoding are as follows, a half channel being a channel which is available for only part of the required frequency band.

Psychoacoustically compensated 3-channel decoder $k_1 = k_2 = t = 1$, $k_3 = 0$ at frequencies $<<$ 400Hz $k_1 = 1.2247$, $k_2 = 0.8660$, $t = 1$, $k_3 = 0$ at frequencies $>>$ 400Hz Basic 2-channel decoder $k_1 = k_2 = 1$, $t = k_3 = 0$ Psychoacoustically compensated 2-channel decoder $t = 0$ and:

$k_1 = 0.6592$, $k_2 = 1.2807$, $k_3 = 0.1545$ at frequencies $<<$ 400Hz $k_1 = k_2 = 1$, $k_3 = 0.4175$ at frequencies $>>$ 400Hz Basic 2½-channel decoder $k_1 = k_2 = t = 1$, $k_3 = 0$ at frequencies for which three channels are available $k_1 = k_2 = 1.1454$, $k_3 = 0$, $t = 0$ when two channels are available 2½-channel decoder with directionally uniform gain $k_1 = k_2 = t = 1$, $k_3 = 0$ when three channels are available $k_1 = k_2 = 1.2162$, $k_3 = 0.5077$ when two channels are available.

The gain is directionally uniform within 0.52 dB limits.

Psychoacoustically compensated 2½-channel decoder $k_1 = k_2 = t = 1$, $k_3 = 0$ at frequencies $<<$ 400Hz $k_1 = 1.2247$, $k_2 = 0.8660$, $k_3 = 0$, $t = 1$ at frequencies $>>$ 400Hz with three available channels $k_1 = k_2 = 1.2162$, $k_3 = 0.5077$, $t = 0$ at h.f. with two available channels Basic 2-channel decoder with directionally uniform gain $k_1 = 1$, $k_2 = 1.15$, $k_3 = 0.3622$, $= 0$ FIG. 2 illustrates an implementation of a decoder of the above-described type. The received signals $\Sigma'$ and $\Delta'$ are applied to respective phase compensation circuits 20 and 22 while the input signal T' is applied to a circuit having relative gain $t$. The output of the circuit 20, 22 and 24 are applied to a WXY circuit, which may be of the type described in copending Application No. 13292/74, which may be implemented by means of a phase-amplitude matrix circuit, and which produces four output signals $w$, $x$, $y$ and $-jw$. In the case when the T channel gain $t = 1$ the signal $w$ has omnidirectional gain, the signals $x$ and $y$ have gains dependent on the cosine and sine respectively of the azimuth angle of the encoded signal and the signal $-jw$ is identical with the signal $w$ except that it has a 90° phase lag.

Thus the WXY circuit may be a phase-amplitude matrix implementing the inverse of the encoder matrix, but provided with an additional output equal to but in quadrature phase relation to the $w$ output.

The outputs from the WXY circuit 26 are applied to respective gains circuits 28, 30, 32 and 34 which apply gain $k_1$ to the signal $w$, gain $k_2$ to the signals $x$ and $y$ and gain $k_3$ to the signal $-jw$ respectively. The output signal $-jwk_3$ from the circuit 34 is combined with the output $yk_2$ from the circuit 32 in an adder 36 to perform a directional biasing operation as described in above-mentioned copending Application No. 46822/75 to produce the signal Y'. The signals W' ($=wk_1$) and X' ($=xk_2$) are produced by the circuits 28 and 30 respectively and all three signals W', X' and Y' are applied to the output matrix 16 which takes the form of an amplitude matrix and produces signals for an array of loudspeakers described above.

As described above, the gains $k_1$, $k_2$, $k_3$ and $t$ may be frequency-dependent in which case any phase shift produced by the circuits 28, 30, 32 and 34 must be matched to one another and the circuits 20 and 22 arranged to provide similar phase shifting to that produced by the gain circuit 24 for example the circuit 24 may be a filter with complex frequency response $$\frac{1 - 0.23\,(\tau\omega)^2}{\{1 + 1.7j\,(\tau\omega) - (\tau\omega)^2\}^2}$$

with time constant $\tau$ equal to, say, 75 $\mu$ sec. In this case, the phase compensation circuits 20 and 22 would be all-pass networks with complex frequency responses

$$\frac{1 - 1.7j\,(\tau\omega) - (\tau\omega)^2}{1 + 1.7j\,(\tau\omega) - (\tau\omega)^2}$$

The above specified values for $k_1$, $k_2$, $k_3$ and $t$ suitable for any systems having the values specified for $u$ and $v$ in JT systems.

It should be understood that the various stages of the decoder illustrated in FIG. 2 may be modified so that the gains are applied at different points provided that overall operation is left unaltered. In addition, the signal paths of X' and Y' signals may incorporate RC high-pass filters with −3dB frequencies substantially equal to $54/d$ Hz, where $d$ is the distance in meters of the loudspeakers from a reference point in the listening area, so as to compensate for unwanted effects on the localisation of sound caused by the curvature of the sound field from the loudspeaker due to finite listening distances.

One commonly used method of encoding directional sound into four channels (denoted LB, LF, RF and RB), is so-called "pairwise mixing" whereby a sound encoded to azimuth $\theta$ is assigned with the gains set out in Table II to each of the four channels Table II

| | $-45° \leqq \theta \leqq 45°$ | $45° \leqq \theta \leqq 135°$ | $135° \leqq \theta \leqq 225°$ | $-135° \leqq \theta \leqq -45°$ |
|---|---|---|---|---|
| LB | 0 | $\cos(135° - \theta)$ | $\sin(225° - \theta)$ | 0 |
| LF | $\cos(45° - \theta)$ | $\sin(135° - \theta)$ | 0 | 0 |
| RF | $\sin(45° - \theta)$ | 0 | 0 | $\cos(-45° - \theta)$ |
| RB | 0 | 0 | $\cos(225° - \theta)$ | $\sin(-45° - \theta)$ |

It is not possible to obtain omnidirectional signals (i.e. signals with directional gain equal to 1) from these signals however, the signals W, X and Y may be obtained with sufficient accuracy for the purposes of the present invention by putting $$W = \frac{1}{\sqrt{2}}\left(\frac{LF + RF}{k_F} + \frac{LB + RB}{k_B}\right)$$

where $0.707 \leqq k_F \leqq 1$ and $0.707 > k_B \leqq 1$ and:

$$X = (1/\sqrt{2}(-LB + LF + RF - RB)$$

$$Y = 1/\sqrt{2}(LB + LF - RF - RB)$$

while encoding using such signals is not strictly correct for all azimuths, the coefficients $k_B$ and $k_F$ may be chosen so that particular selected azimuths are encoded correctly. The encoded signals derived from W, X and Y so obtained may then be decoded in accordance with the invention.

Information concerning the height of a sound source may be added to any three-channel system by adding a fourth channel Q containing the required additional information. Using the above notation, the four channels have directional gains given by $$\begin{pmatrix} \Sigma \\ \Delta \\ T \\ Q \end{pmatrix}_{gain} = \begin{pmatrix} a & c & je & 0 \\ jb & jd & f & 0 \\ jgq & jhq & iq & 0 \\ 0 & 0 & 0 & s \end{pmatrix} \begin{pmatrix} 1 \\ \cos\theta\cos\eta \\ \sin\theta\cos\eta \\ \sin\eta \end{pmatrix}$$

where $s$ is a complex gain for the Q channel and $\eta$ is the elevation angle above horizontal. Such information may then be decoded for horizontal reproduction using the decoders described above from the signals in the first three channels and ignoring the Q channel.

With-height reproduction may be obtained using a suitable loudspeaker layout by deriving the signals W', X' and Y' from the signals Σ, Δ and T as described above with $k_1 = k_2 = 1$, $k_3 = 0$, $t = 1$, so that their directional gains are 1, $\cos\theta\cos\eta$ and $\sin\theta\cos\eta$ respectively, and deriving the further signal $Z' = s^{-1}Q$ which has directional gain $\sin\eta$. For regular polyhedron loudspeaker layouts, the loudspeaker with direction cosines $p_i$, $q_i$ and $r_i$ is fed with the signal:

$$k_1'W' + k_2'p_iX' + k_2'q_iY' + k_2'r_iZ'$$

where $k_1'$ and $k_2'$ are positive gains which may vary with frequency. For example these gains might be $k_1 = 1$ and $k_2' = 3$ for frequencies substantially below 400Hz and $K_1' = \sqrt{2}$ and $k_2' = \sqrt{6}$ for frequencies substantially above 400

More generally, decoded signals W', X', Y', Z' may be derived from Σ, Δ, T, Q by a phase amplitude matrix such that $$\mathrm{Re}\,(X'/W') : \mathrm{Re}\,(Y'/W') : \mathrm{Re}\,(Z'/W') \cong \cos\theta\cos\eta : \sin\theta\cos\eta : \sin\eta,$$

which will ensure substantially correct directional reproduction according to Makita's theory of sound localisation. For example W', X', Y' can be derived as in any of the three-channel decoders described earlier and Z' can be chosen to be a suitable real multiple of $s^{-1}Q$.

In the case of reproduction via a cuboid of eight loudspeakers at directions with direction cosines $p''$, $q''$, $r''$ equal to $\pm p'$, $\pm q'$, $\pm r'$ respectively for some $p'$, $q'$, $r'$, the associated speaker feed signals will be $$k_1'\,W' + \tfrac{1}{2}k_2'\,X'/p'' + \tfrac{1}{2}k_2'\,Y'/q'' + \tfrac{1}{2}k_2'Z'/r''$$

for positive coefficients $k_1'$, $k_{2'}$. The output matrix of such a cuboid decoder may be as described in copending U.S. Pat. No. 3,997,725.

With any form of the invention, the signals L and R may be transmitted in place of the signals Σ and Δ, the relationship between the two pairs of signals being $$L = \tfrac{1}{2}(\Sigma + \Delta)$$

$$R = \tfrac{1}{2}(\Sigma - \Delta)$$

In a similar way, the phase-amplitude matrices or WXY circuits of the decoders may be designed to operate from the signals L and R rather than the signals Σ and Δ.

It will be understood that all gains, phase shifts, filters and matrix circuits may be rearranged, split into several stages, and/or combined, and that overall gains or phase shifts equally affecting parallel signal paths may be introduced, in ways evident to those skilled in the art without affecting the overall operation of encoders or decoders according to this invention. In particular, when the decoder gains $k_1$, $k_2$, $k_3$ are not dependent on frequency, parts of the decoder subsequent to any desired filtering of the input channels Σ', Δ' or Σ', Δ', T' or L', R' or L', R', T' may be implemented as a single fixed phase-amplitude matrix if desired.

I claim:

1. A system for transmitting or recording an azimuthal directional sound comprising encoding means producing a plurality of transmission channel signals comprising complex linear combinations of omnidirectional signal components, signal components having gains equal to the cosine of the encoded sound azimuthal angle and signal components having gains equal to the sine of the encoded sound azimuthal angle, the encoding means comprising a phase-amplitude matrix arranged to produce first, second and third transmission channel signals, the first and second transmission channel signals having gains for sounds associated with an azimuth angle $\theta$ which are respective independent linear combinations of $\Sigma_{gain}$ and $\Delta_{gain}$ given by:

$$\Sigma_{gain} = a + c\cos\theta + je\sin\theta$$

$$\Delta_{gain} = jb + jd\cos\theta + f\sin\theta$$

where $j$ (= −1) represents a 90° phase shift and where $a$, $b$, $c$, $c$, $e$ and $f$ are real gains such that, for any chosen angle $\theta'$, the quantities given substantially by:

$$h = v^{-1}\left\{\frac{1 + u^2\sin^2\theta'}{1 - (u/v)^2\cos^2\theta'}\right\}^{\frac{1}{2}}$$

$$g = \frac{h^2}{1 + vh}\left\{\frac{u\,(\cos^2\theta' + v^2\sin^2\theta'}{1 + u^2\sin^2\theta'}\right\}$$

where:

$$u = (cf + ed/bc - ad)\ v = -\,(be + af/bc - ad)$$

are such that $1 - (u/v)\cos^2\theta'$ is positive and that the pair $(u, v)$ has neither of the values (0, 1) and (0, −1), the third transmission channel signal having a gain $T_{gain}$ given by:

$$T_{gain} = q\,(jg + jh\cos\theta + i\sin\theta)$$

where $q$ is a non-zero complex gain, $g$ and $h$ are real gains and = −1.

2. A system according to claim 1, wherein the first and second transmission channel signals have respective complex gains which are the same real or complex multiple of one of the pairs $\Sigma_{gain}$, $\Delta_{gain}$ and L gain, R gain where $$\text{L gain} = \tfrac{1}{2}\,\Sigma_{gain} + \tfrac{1}{2}\,\Delta_{gain}$$

$$\text{R gain} = \tfrac{1}{2}\,\Sigma_{gain} - \tfrac{1}{2}\,\Delta_{gain}.$$

3. Means for reproducing azimuthal directional sound transmitted or recorded by a system according to claim 1, comprising a decoder for producing loudspeaker feed signals from a plurality of transmission channel signals, wherein the feed signals for the loudspeaker at azimuth $\phi$ is of the form $$P_\psi = \lambda a'\,k_1 + 2b'k_2 j\cos\psi + (2g'\,k_2 - a'\,k_3)j\sin\psi]\,\Sigma' + [c'\,k_1 j + 2d'\,k_2 j\cos\psi + (2h'\,k_2 + c'\,k_3)\sin\psi]\,\Delta' + t[e'\,k_1 j + 2f'\,k_2 j\cos\psi + (2i'\,k_2 + e'\,k_3)\sin\psi]\,q^{-1}T'$$

where $\phi = \psi$ for a regular polygonal layout and $\psi = 90° - \phi', 90° + \phi', -90° - \phi'$ and $-90° + \phi'$ for the respective azimuths $\phi = \phi', 180° - \phi', -180° + \phi'$ and $-\phi'$ of a rectangular layout, where $k_1, k_2$ are positive gains, $k_3$ is a real gain, $t$ is a gain such that $-0.2 < t < 1.4$, where the real gains $a', 2b', c', 2d', e', 2f', 2g', 2h', 2i'$ are related to the gains $a, b, c, d, e, f, g, h, i$ of the encoding equations by the matrix equation $$\begin{pmatrix} a' & c' & e' \\ b' & d' & f' \\ g' & h' & i' \end{pmatrix} = \begin{pmatrix} a & c & e \\ b & d & f \\ g & h & i \end{pmatrix}^{-1}$$

where $q$ is the complex gain of the signal T in the encoding equations, and where $\Sigma', \Delta', T'$ are proportional to the signals $\Sigma, \Delta, T$.

4. A system according to claim 1, wherein:

$$h = v^{-1}\left\{\frac{4 + 3u^2}{4 - (\frac{u}{v})^2}\right\}^{\frac{1}{2}}$$

$$g = \frac{h^2}{1 + vh}\left\{\frac{u\,(1 + 3v^2)}{4 + 3u^2}\right\}$$

5. A system according to claim 4, wherein: $a = 0.9530, b = -0.3029, c = 0.2554, d = 0.8034, e = 0.0661, f = 0.9593, g = -0.1716, h = 1.0000$ and $i = -1.0000$.

6. A system according to claim 4, wherein: $a = 0.9694, b = -0.2457, c = 0.2191, d = 0.8643, e = 0.1104, f = 1.0036, g = -0.1716, h = 1.0000$ and $i = -1.0000$.

7. A system according to claim 4, wherein: $a = 0.9829, b = -0.1842, c = 0.1725, d = 0.9203, e = 0.1645, f = 1.0412, g = -0.1716, h = 1.0000$ and $i = -1.0000$.

8. A system according to claim 4, wherein: $a = 0.9915, b = -0.1305, c = 0.2030, d = 0.6580, e = -0.1305, f = 0.9915, g = -0.0733, h = 0.6873$ and $i = -1.0000$.

9. A system according to claim 1, wherein the input signals for the encoding means are derived from a microphone assembly producing at least three intermediate signals, the first of which is an omnidirectional signal comprising the sum of all azimuthal sound sources with identical gains, the second of which is the sum of the signals of all azimuthal sound sources each having gain proportional to the cosine of its respective encoded azimuthal angle, and the third of said intermediate signals comprising the sum of the signals of all azimuthal sound sources each having gain proportional to the sine of its respective encoded azimuthal angle.

10. A system according to claim 1, wherein the input signals for the encoding means are produced by a plurality of independent monophonic signal sources and an amplitude matrix mixing means producing three or more intermediate signals, the first of such intermediate signals comprising the sum of all said monophonic signals with identical gains, the second of said intermediate signals comprising the sum of all said monophonic signals after each has been subject to a gain proportional to the cosine of its respective encoded azimuth angle and the third of such intermediate signals comprising the sum of all the monophonic signals after each has been subject to a gain proportional to the sine of its respective encoded azimuthal angle.

11. A system according to claim 1, wherein the input signals comprise four signals LB, LF, RF and RB representing sound at left back, left front, right front and right back respectively, and an amplitude matrix producing three intermediate signals W, X and Y given by:

$$W = m[k_F^{-1}(LF + RF) + 1k_B^{-1}(LB + RB)]$$

$$X = n[(LF + RF) - 1\,(LB + RB)]$$

$$Y = n[(LF - RF) + 1\,(LB - RB)]$$

where $m$ and $n$ are greater than zero and where $k_F$, $k_B$ and 1 are positive gains such that $$2^{-\frac{1}{2}} \leqq k_F \leqq 1$$

$$2^{-\frac{1}{2}} \leqq k_B \leqq 1$$

$$2^{-\frac{1}{2}} \leqq 1 \leqq 2^{178}$$

12. Means for reproducing azimuthal directional sound transmitted or recorded by a system according to claim 1, comprising a decoder for producing feed signals from a plurality of transmission channel signals, the feed signals being arranged to produce at a predetermined listening position, via loudspeaker transducing means, acoustic pressure and an acoustic velocity vector such that, at each frequency of sound, the vector formed by the components of the complex acoustic velocity vector bearing a quadrature phase relationship to the components of the acoustic pressure points in a decoded azimuth angle direction is substantially equal to said encoded azimuth angle direction for all encoded azimuth angles.

13. Means for reproducing azimuthal directional sound transmitted or recorded by a system according to claim 2, comprising a decoder for producing loudspeaker feed signals from a plurality of transmission channel signals, wherein the feed signals for the loudspeaker at azimuth $\phi$ is of the form $$P\psi = [i'\,k_1 + 2b'\,k_2 j\cos\psi + (2g'\,k_2 - a'\,k_3)j\sin\psi]\,\Sigma' + [c'\,k_1 j + 2d'\,k_2 j\cos\psi + (2h'\,k_2 + c'\,k_3)\sin\psi]\,\Delta' + t[e'\,k_1 j + 2f'\,k_2 j\cos\psi + (2i'\,k_2 + e'\,k_3)\sin\psi]\,q^{-1}T'$$

where $\phi = \psi$ for a regular polygonal layout and $\psi = 90° - \phi', 90° + \phi', -90° - \phi''$ and $-90° + \phi'$ for the respective azimuths $\phi = \phi', 180° - \phi', -180° + \phi'$ and $-\phi'$ of a rectangular layout, where $k_1, k_2$ are positive gains, $k_3$ is a real gain, $t$ is a gain such that $-0.2 < t < 1.4$, where the real gains $a', 2b', c', 2d', e', 2f', 2g',$ $2h'$, $2i'$ are related to the gains $a, b, c, d, e, f, g, h, i$, of the encoding equations by the matrix equation $$\begin{pmatrix} a' & c' & e' \\ b' & d' & f \\ g' & n' & i' \end{pmatrix} = \begin{pmatrix} a & c & e \\ b & d & f \\ g & h & i \end{pmatrix}^{-1}$$

where $q$ is the complex gain of the signal T in the encoding equations, and where $\Sigma'$, $\Delta'$, $T'$ are proportional to the signals $\Sigma$, $\Delta$, T or to the signals L + R, L − R, T.

14. Means for reproducing azimuthal directional sound according to claim 13, wherein:

$a' = 0.9857$, $2b' = 0.5228$, $c' = 0.1058$, $2d' = -1.0785$, $e' = 0.1667$, $2f' = -1.0000$, $2g' = 0.1846$, $2h' = 1.1148$, $2i' = -0.9428$.

15. Means for reproducing azimuthal directional sound according to claim 13, wherein:

$a' = 0.9876$, $2b' = 0.4418$, $c' = 0.0575$, $2d' = -1.0450$, $e' = 0.1667$, $2f' = -1.0000$, $2g' = 0.1030$, $2h' = 1.0647$, $2i' = -0.9428$.

16. Means for reproducing azimuthal directional sound according to claim 13, wherein:

$a' = 0.9876$, $2b' = 0.3654$, $c' = 0.0040$, $2d' = -1.0181$, $e' = 0.1667$, $2f' = -1.0000$, $2g' = 0.0265$, $2h' = 1.0195$, $2i' = -0.9428$.

17. Means for reproducing azimuthal directional sound according to claim 13, wherein:

$a' = 0.9744$, $2b' = 0.2956$, $c' = 0.2129$, $2d' = -1.4286$, $e' = 0.0839$, $2f' = -1.4549$, $2g' = 0.0603$, $2h' = 1.0131$, $2i' = -0.9877$.

18. Means for reproducing azimuthal directional sound according to claim 12, wherein the decoder includes a modified inverse matrix comprising a phase-amplitude matrix which is the inverse of the phase-amplitude matrix of the encoder, modified by gain factors.

19. Means for reproducing azimuthal directional sound according to claim 18, wherein the modified inverse matrix is arranged to provide a fourth output equal to the signal representative of acoustic pressure phase-shifted by 90°.

20. Means for reproducing azimuthal directional signals according to claim 12, wherein the vector derived from the modified recovered signals is arranged to point in the direction of the encoded azimuth angle for six predetermined angles which are symmetrically disposed relative to a reference direction.

21. Means for reproducing azimuthal directional signals according to claim 20, wherein said azimuth angles are symmetrical relative to two mutually orthogonal reference directions.

22. Means for reproducing azimuthal directional signals according to claim 21, wherein said six angles are 0°, 60°, 120°, 180°, −60° and −120°.

* * * * *

UNITED STATES PATENT OFFICE

CERTIFICATE OF CORRECTION

Patent No. 4,095,049 Dated June 13, 1978

Inventor(s) Michael Anthony GERZON

It is certified that error appears in the above-identified patent and that said Letters Patent are hereby corrected as shown below:

Column 13, lines 5-7, the equation should read:

$$\begin{pmatrix} a' & c'j & e'j \\ b' & d'j & f'j \\ g'j & h' & i' \end{pmatrix} = \begin{pmatrix} a & c & ej \\ bj & dj & f \\ gj & hj & i \end{pmatrix}^{-1}$$

where $j = \sqrt{-1}$

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,095,049

DATED : June 13, 1978

INVENTOR(S) : Michael Anthony GERZON

It is certified that error appears in the above-identified patent and that said Letters Patent are hereby corrected as shown below:

Column 10, line 40, should read where j (= $\sqrt{-1}$) represents a 90° phase shift and where Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,095,049

DATED : June 13, 1978

INVENTOR(S) : Michael Anthony GERZON

It is certified that error appears in the above-identified patent and that said Letters Patent are hereby corrected as shown below:

Column 11, lines 26 through 28, the equation should read:

$$\begin{pmatrix} a' & c'j & e'j \\ b' & d'j & f'j \\ g'j & h' & i' \end{pmatrix} = \begin{pmatrix} a & c & ej \\ bj & dj & f \\ gj & hj & i \end{pmatrix}^{-1}$$

where $j = \sqrt{-1}$

Signed and Sealed this

*Eighteenth* Day of *September 1979*

[SEAL]

*Attest:*

*Attesting Officer*

LUTRELLE F. PARKER

*Acting Commissioner of Patents and Trademarks*